United States Patent [19]

Braun et al.

[11] Patent Number: 4,526,729

[45] Date of Patent: Jul. 2, 1985

[54] VORTEX CARBURETOR

[76] Inventors: Alfred J. Braun, Country Rte. 1, Box 46, Mineral Springs Rd., Warnersville, N.Y. 12146; Aron Burdick, P.O. Box 87, N. Hoosick, N.Y. 12133; Henry A. Scarton, 43 S. Lake Ave., Troy, N.Y. 12180

[21] Appl. No.: 460,998

[22] Filed: Jan. 26, 1983

[51] Int. Cl.[3] ..... F02M 9/08

[52] U.S. Cl. ..... 261/36 A; 261/44 A; 261/44 E; 261/44 G; 261/64 R; 261/69 R; 261/DIG. 2; 137/868; 137/887

[58] Field of Search ..... 261/44 A, 44 E, 44 F, 261/44 G, DIG. 56, 36 A, 64 R, 69 R; 137/867, 868, 887

[56] References Cited

U.S. PATENT DOCUMENTS

| | | | |
|---|---|---|---|
| 1,072,492 | 9/1913 | Pierson | 261/DIG. 38 |
| 1,269,177 | 6/1918 | Gilles | 261/44 A |
| 1,305,744 | 6/1919 | Rhoads | 261/44 A |
| 1,324,510 | 12/1919 | McCurdy | 261/44 A |
| 1,520,926 | 12/1924 | Brown, Jr. | 261/44 A |
| 1,553,447 | 9/1925 | Jackson | 251/254 |
| 1,585,741 | 5/1926 | Thewes | 261/44 E |
| 1,795,685 | 3/1931 | Stehle | 261/44 A |
| 1,893,920 | 1/1933 | Winfield | 261/44 E |
| 1,951,262 | 3/1934 | Townsley | 261/44 A |
| 2,017,239 | 10/1935 | Fitzgerald | 261/44 E |
| 2,196,829 | 1/1940 | Haddock . | |
| 2,333,030 | 10/1943 | Meyer | 261/65 |
| 2,590,000 | 3/1952 | Ferguson . | |
| 2,598,308 | 5/1952 | Samuels et al. | 251/252 |
| 2,641,437 | 6/1953 | Jay et al. | 251/252 |
| 2,995,349 | 8/1961 | Kennedy, Sr. . | |
| 3,220,709 | 11/1965 | Pickron et al. | 261/50 R |
| 3,778,038 | 12/1973 | Eversole et al. | 261/62 |
| 3,953,548 | 4/1976 | Knapp et al. | 261/DIG. 56 |
| 4,036,914 | 7/1977 | Hawryluk . | |
| 4,065,526 | 12/1977 | Englert et al. | 261/DIG. 56 |
| 4,190,032 | 2/1980 | Wright . | |
| 4,292,257 | 9/1981 | Knowlton | 261/44 A |
| 4,318,868 | 3/1982 | Showalter et al. | 261/44 F |
| 4,411,233 | 10/1983 | Chenet et al. | 261/44 F |

FOREIGN PATENT DOCUMENTS

| | | | |
|---|---|---|---|
| 2219880 | 10/1973 | Fed. Rep. of Germany | 261/DIG. 56 |
| 58608 | 11/1946 | Netherlands | 261/44 F |
| 19739 | of 1912 | United Kingdom | 261/44 G |
| 128711 | 6/1919 | United Kingdom | 261/44 E |
| 154499 | 12/1920 | United Kingdom | 261/DIG. 56 |

OTHER PUBLICATIONS

Lichty, Combustion Engine Processes, McGraw-Hill Inc., 1967, Chapter 9.

*Primary Examiner*—Tim Miles
*Attorney, Agent, or Firm*—McGlew and Tuttle

[57] ABSTRACT

A high velocity carburetor comprises a housing defining an air flow conduit with an air valve member therein. The air valve member includes a curved air-conducting surface facing the air stream and at least one position of the member for establishing a vortex flow. Fuel is supplied through the axial center of rotation of the air valve member to the conduit and into the vortex stream for facilitating atomization of the fuel into the air stream. The valve member is J-shaped or cylindrical. A fuel metering device is provided through the axial center of rotation of the air valve member which includes an axially movable but rotationally fixed inner fuel conduit mated to a rotationally movable but axially fixed outer tube. A cam is provided on the outer tube with a cam follower on the other tube to establish a needle fuel valve or metering fuel to the air conduit. This carburetor can be used in either a power-increasing or a fuel-efficient mode.

9 Claims, 27 Drawing Figures

FIG. 4
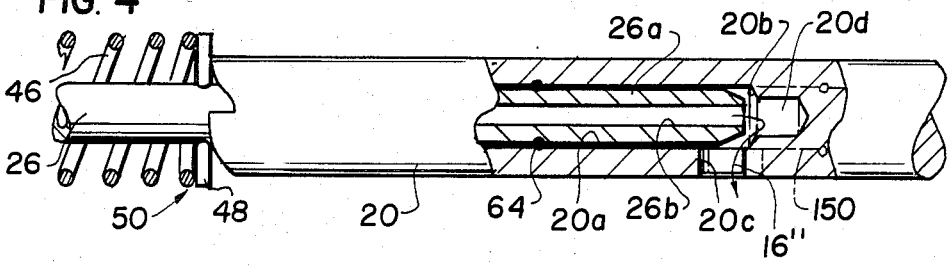
FIG. 5
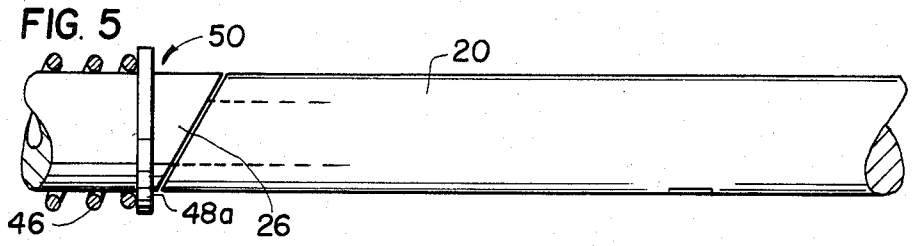
FIG. 6
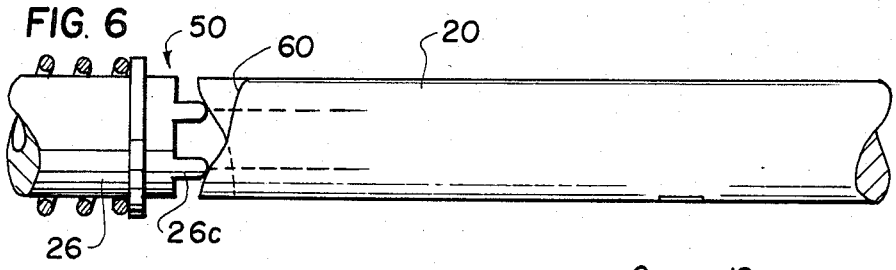
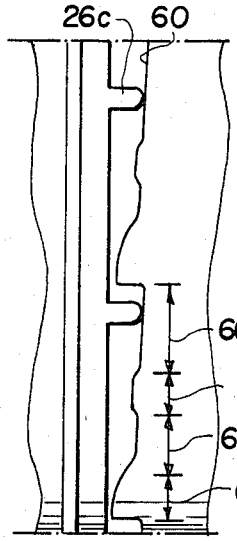
FIG. 7
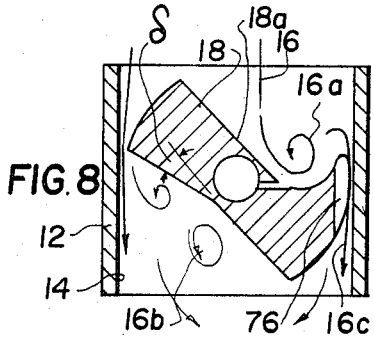
FIG. 8
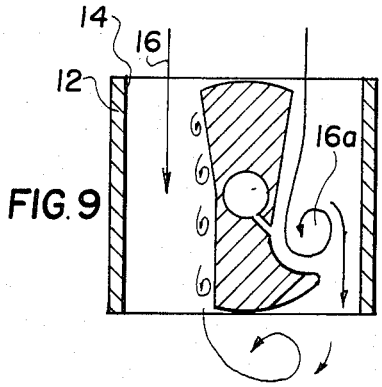
FIG. 9

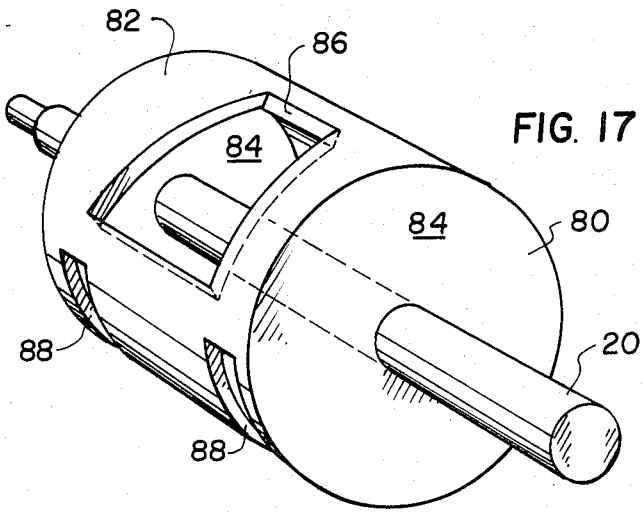
FIG. 17
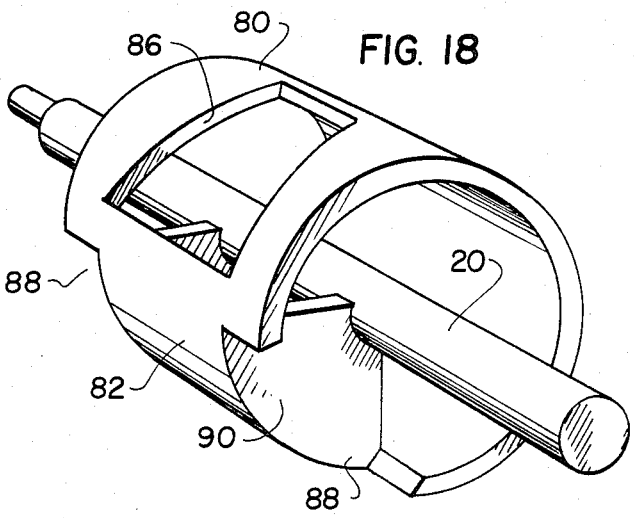
FIG. 18
FIG. 19
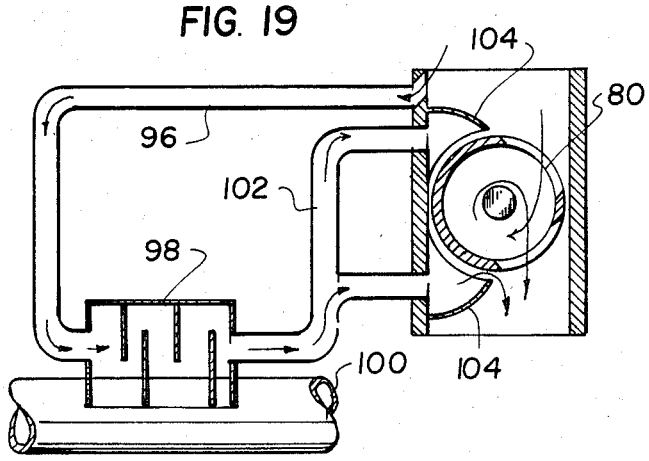

FIG. 23
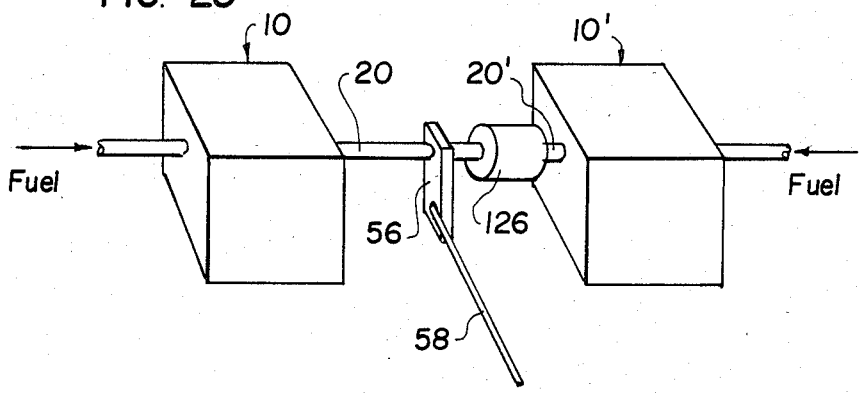
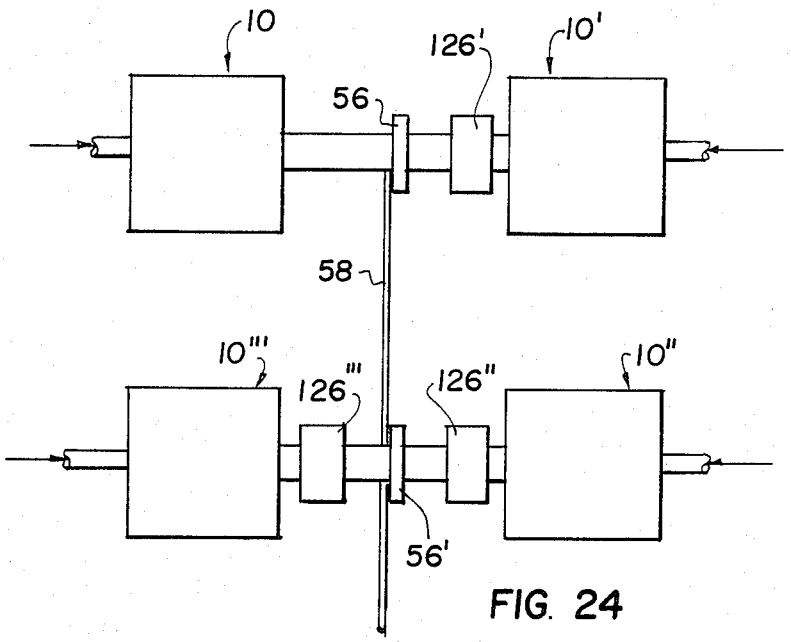
FIG. 24

VORTEX CARBURETOR

FIELD AND BACKGROUND OF THE INVENTION

The present invention relates in general, to carburetors and in particular to a new and useful vortex high air velocity energy-efficient carburetor which utilizes a specially-shaped air valve through which fuel is introduced into an air stream, and which also utilizes a fuel metering arrangement which regulates the amount of fuel supplied to the air stream.

The field of carburetor design, in particular, with regard to internal combustion engines, is highly developed. The major function of a carburetor is to establish an air-fuel mixture by finely atomizing the fuel in an air stream. Improvements can still be made in the degree of atomization for fuel in the air stream and also the accuracy in providing desired proportions for the air-fuel mixture.

The subject of carburetor design is comprehensively covered in the publication COMBUSTION ENGINE PROCESSES, by L. C. Lichty, McGraw-Hill Inc. 1967 at Chapter 9. U.S. Pat. No. 4,036,914 to Hawryluk and 2,590,000 to Ferguson both teach the use of chambers into which fuel is injected to improve the atomization of fuel in an air fuel mixture.

U.S. Pat. No. 4,292,257 to Knowlton shows the use of a valve member in a conduit for receiving a flow of air, which valve member is utilized for the introduction of selected amounts of fuel to the air stream. Similar teaching can be found in U.S. Pat. No. 4,190,032 to Wright and U.S. Pat. No. 2,995,349 to Kennedy, Sr. U.S. Pat. No. 2,196,829 to Haddock shows the use of a rotatable turbine in an air stream to improve air-fuel mixing.

SUMMARY OF THE INVENTION

The present invention comprises a high air velocity carburetor which includes conduit means defining an air flow conduit for carrying a flow of air in a flow direction, an air valve member in the air flow conduit and movably mounted to the conduit means from a closed position for reducing air flow in the conduit to an open position for increasing air flow in the conduit, the valve member having a curved air flow conducting surface facing toward the incoming air flow direction with the valve member in at least one of its closed and open positions, and fuel metering means connected to the valve member for providing fuel to the curved air flow conducting surface.

Another object of the invention is to provide a fuel metering device which can be used with the inventive carburetor or other carburetor structures, which metering device comprises a housing defining a frame of reference, a first fuel conduit rotatably mounted to said housing having a portion forming one of fuel valve seat and a fuel valve projection, a second fuel conduit mounted for axial movement to said housing and having a portion forming the other one of said valve seat and valve projection, the valve seat of one of the first and second conduits facing the valve projections of the other of the first and second fuel conduits, and cam means defined between said first and second fuel conduits for axially moving said second fuel conduit with rotation of said first fuel conduit to regulate a distance between said valve seat and projection, one of said first and second fuel conduits having an opening for the passage of fuel away from the valve seat and valve projection.

A still further object of the invention is to provide a high air speed carburetor wherein the air valve member is J-shaped.

Another object of the invention is to provide such a high speed carburetor which includes an air plate adjustably positioned over a portion of the curved air flow conducting surface.

A further object of the invention is to provide a high-speed carburetor which includes a valve member that is substantially cylindrical with a hollow interior through which the fuel metering means extends, the valve member having an inlet port and at least one outlet port, and interior walls defining the curved air flow conducting surface.

A further object of the invention is to provide a high-speed carburetor, and a fuel metering device both of which are simple in design, rugged in construction and economical to manufacture.

A further object of the invention is to provide a carburetor which can be used not only for road application but also for marine, stationary and aircraft engines, particularly for inverted flight systems.

A further object of the invention is to provide energy efficient and/or power increasing operation.

For an understanding of the principles of the invention, reference is made to the following description of typical embodiments thereof as illustrated in the accompanying drawings.

BRIEF DESCRIPTION OF THE DRAWINGS

In the drawings:

FIG. 4 is a fragmentary elevational view with portions shown in section of the fuel metering device according to the invention;

FIGS. 5 and 6 are fragmentary elevational views showing other embodiments of the fuel metering device;

FIG. 7 is a generated illustration showing cam means used in the embodiment of FIG. 6;

FIG. 8 is a simplified sectional view of the embodiment of FIG. 1 showing the air J-valve member in its substantially closed or idle position;

FIG. 9 is a view similar to FIG. 8 showing the air J-valve member in its substantially open or full throttle position;

FIGS. 17 and 18 are perspective views of two embodiments of the air valve member which is positionable in accordance with FIGS. 13–15;

FIG. 19 is a schematic representation of a heating arrangement for preventing icing when operating the carburetor using the air valve member according to FIGS. 17 and 18;

FIG. 23 is a simplified perspective view of a two-barrel carburetor in accordance with the invention;

FIG. 24 is a simplified top plan view of a four-barrel carburetor in accordance with the invention;

DESCRIPTION OF THE PREFERRED EMBODIMENTS

Figure 1:
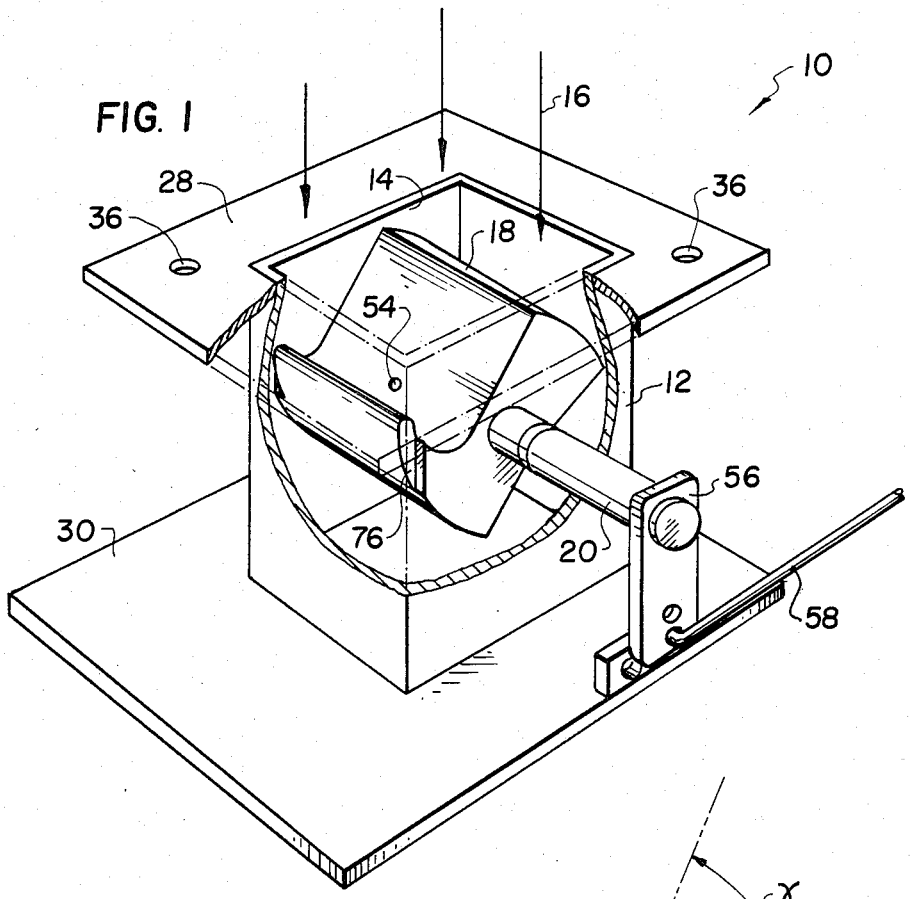
FIG. 1 is a perspective view of one embodiment of the vortex carburetor according to the invention, with portions cut away for clarity.
Figure 2:
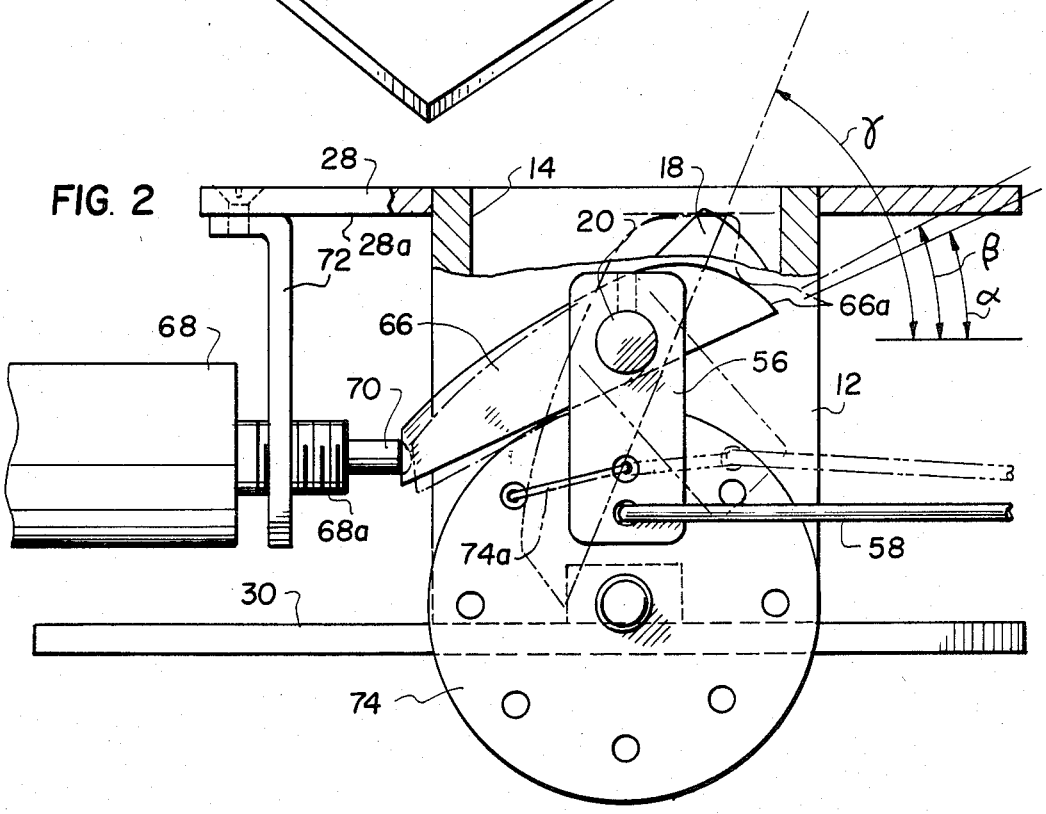
FIG. 2 is a side elevational view of the embodiments shown in FIG. 1 with portions cut away for clarity.
Figure 3:
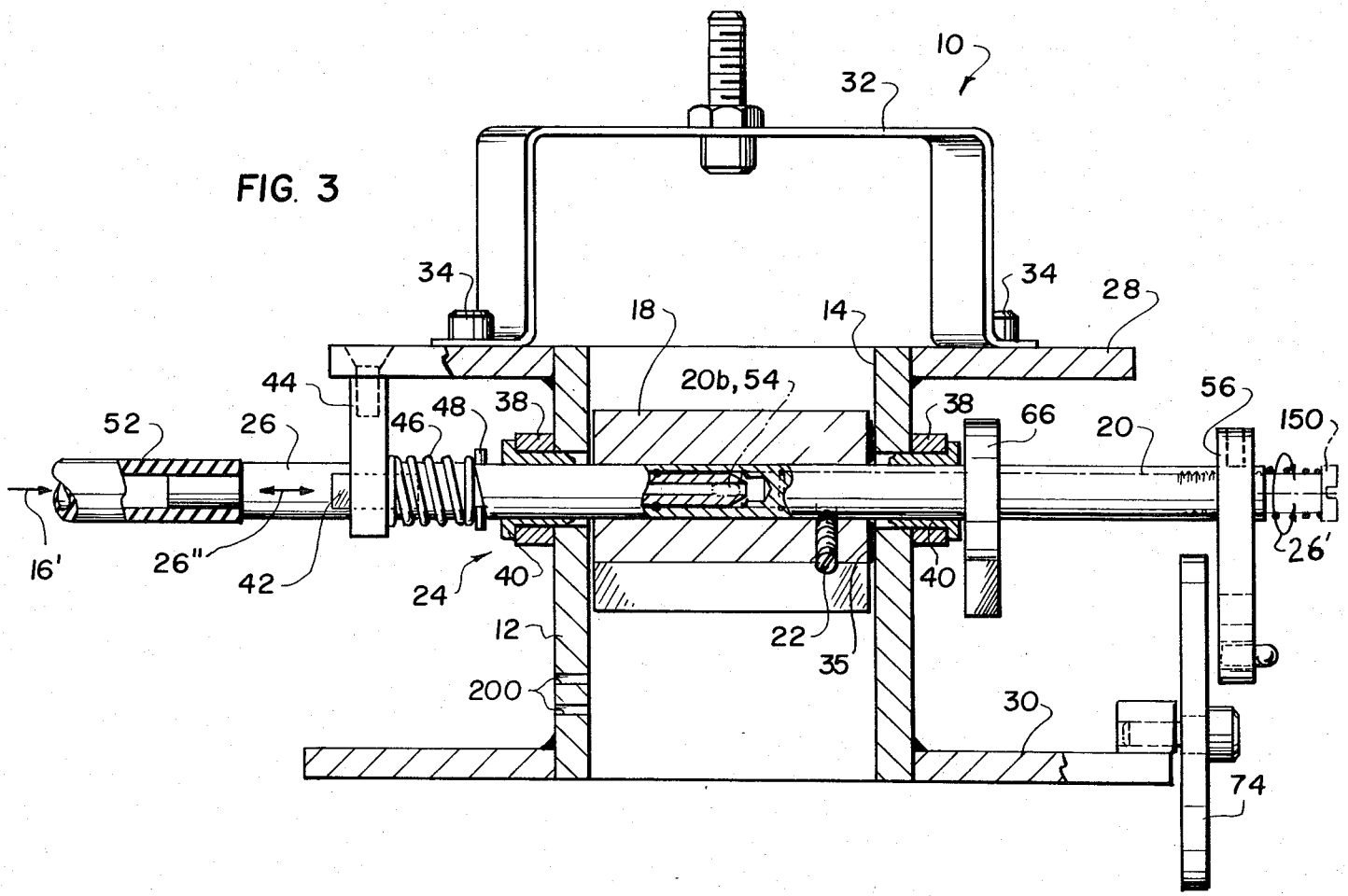
FIG. 3 is a front sectional view of the embodiment of FIG. 1 with portions shown in elevation.

Referring to the drawings, in particular, the invention embodied therein, In FIGS. 1–3, comprises a high velocity vortex carburetor generally designated 10 having a housing 12 which defines an air flow conduit 14 for the passage of air in an air flow direction 16. An air valve member 18 is rotatably mounted to housing 12 and disposed in conduit 14. As best shown in FIG. 3, air valve member 18 is fixed to a partially hollow outer tube 20, for co-rotation therewith by a set screw 22. Tube 20 forms a first full conduit and one major component of a fuel metering device generally designated 24 including a hollow inner tube 26.

Housing 12 includes upper and lower flange plates 28,30 which can be connected, for example by welding, to the portion of housing 12 defining conduit 14. Housing 12 with flanges can also be cast in one single piece. Lower flange plate 30 can be mounted to the intake manifold of an internal combustion engine for supplying the engine with an air-fuel mixture. An air cleaner bracket 32 is connected to upper plate 28 by bolts 34 screwed into bracket holes 36.

Outer tube 20 extends through aligned openings of housing 12 and is rotatably (in the direction of double arrow 26') mounted to those openings at a pair of bushing blocks 38, which hold tube 20 in an axially fixed relationship with housing 12 over bushings 40.

Inner tube 26 is axially movable with respect to housing 12 in the direction of the double arrow 26'', and held against rotation by its flat surfaces 42 which are held in a fork 44 connected to upper plate 28. Tube 26 is biased toward tube 20 by spring 46 which bears against pin 48 connected to a smaller diameter portion of the tube 26. A fuel line 52 is connected to an opposite end of tube 26. Feed direction 16' is indicated in FIG. 3.

A thrust washer or bearing 35 is set between conduit 14 and air valve 18 on the linkage side in this embodiment to take up axial pressure generated by spring 46.

Referring to FIG. 4, cam means 50 are provided between tubes 26 and 20 so that rotation of tube 20 will cause axial movement of tube 26. The small diameter portion **26*a* of tube 26 is provided in a slightly larger inner passage 20*a* of tube 20. Tube 26 includes a fuel conduit 26*b* defined therethrough and emptying at the end into passage 20*d* and through port 20*c*. Tube 20 defines a valve seat 20*b* with the end of small diameter portion 26*a* forming a valve member which is moved toward and away from valve seat 20*b* to establish an amount of fuel flow. The fuel flowing in direction 16'' through conduit 26*b* and into passage 20*d* empties through opening 20*c* and an aligned opening 54 in air valve member 18 (FIG. 1), into air conduit 14, and thus into the air stream 16. The opening 54** is shown centrally located in the preferred embodiment. An "acentral" or noncentral location is also a possible alternate.

Outer hollow tube 20 is rotatable by a lever 56 which is connected to a throttle linkage or cable assembly 58. Fuel line 52 is pressurized so that, with a selected rotation of lever 56 a desired amount of fuel is metered out into the air stream through opening 54. A fuel pressure regulator (not shown) may be needed in the fuel line in order to guarantee a fixed pressure drop in the needle valve and hence a known flow of fuel for a given setting. The tubes 26, 20 with the aid of cam means 50 thus form a metering needle valve assembly.

Fuel can be supplied to the air stream with the use of an accelerating pump or a fuel reservoir. In addition, no separate idling system is required as used in conventional carburetor designs.

A nominal setting of the air-fuel ratio can be established by a minor rotational adjustment of the air valve member 18 with respect to the hollow outer tube 20. Setting screw 22 may be loosened to permit this rotation and then re-tightened.

An optionally manner of setting the nominal air-fuel ratio is shown in dot-dashed line in FIG. 3. A mixture screw 150 extends axially in tube 20 and carries the valve seat **20*b*. Screw 150 has an externally threaded portion which can be threaded into an internally threaded portion of tube 20. A biasing spring is provided between tube 20 and screw 150 so that an exact positioning of valve seat 20*b* can be established. An O-ring can be provided between the screw 150 and the interior of tube 20 to prevent fuel leakage into the space between screw 150 and tube 20. In this form of the invention fuel discharge port 20*c* should be also be enlarged as shown in dot-dash line in FIG. 4**.

Figure 25:
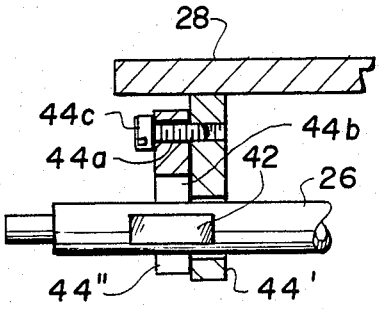
FIG. 25 is a partial sectional view of another embodiment of the invention for setting air-fuel mixture.
Figure 26:
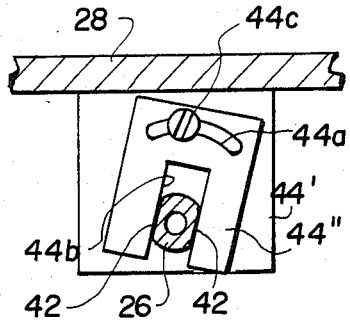
FIG. 26 is a front elevational view of the structure shown in FIG. 25.
Figure 27:
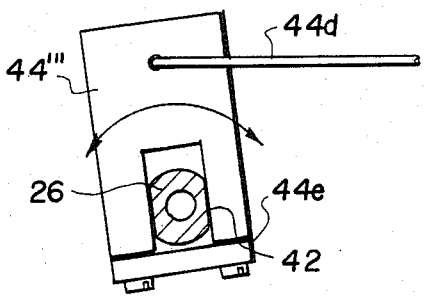
FIG. 27 is a view similar to FIG. 26 of another embodiment of the air-fuel setting device.

Another embodiment for setting the nominal air-fuel ratio is shown in FIGS. 25 and 26. Whereas the use of screw 150 utilizes an axial movement of the valve seat, the embodiments of FIGS. 25 and 26 take advantage of a slight rotation of the hollow inner tube 26. For this purpose, the fixed fork 44 of FIG. 3 is replaced by a fixed fork support 44' having an opening therethrough for receiving tube 26. The opening is slightly larger in diameter than the tube 26 to permit free axial and rotational movement of the tube. An arm 44'' is mounted on support 44' by a locking screw **44*c* extending through an arcuate slot 44*a* of arm 44''. Arm 44'' includes a slot 44*b* which engages the opposite flat surfaces 42 of tube 26. By rotating arm 44'' into a desired location after loosening screw 44*c*, the nominal air-fuel mixture can be set as desired. An alternative arrangement is shown in FIG. 27 where fork 44''' is mounted only to tube 26 by connecting plate 44*e*. A linkage 44*d* is connected to fork 44'''for rotation thereof. Tube 26 is permitted to move axially in the slot formed by fork 44'''. The mixture can thus automatically or manually be leaned or enriched. This is especially necessary in aircraft applications while flying at high altitudes since the air density equals air pressure divided by RT where R is the gas constant and T is the absolute temperature. The limiting air speed however is equal to the square root of the ratio of specific heats times RT. The air speed is thus limited by temperature. The air mass flow rate into the carburetor is equal to density times ambient air speed times the cross sectional area through which the air passes. The change in flow rate requires an adjustment in fuel supply which can be automatically or manually established using arm 44''' and linkage 44***d*. This can also be true of vehicles which travel between high and low elevations. The adjustment device shown in FIG. 21 and to be described hereinunder, can be utilized with the control apparatus of FIG. 27. In addition to the oxygen and temperature sensors, a barometric pressure sensor can be utilized to compensate, through the lean-rich adjustment mechanism, for pressure changes.

As shown in FIGS. 5,6 and 7, where similar elements are designated with similar reference numerals, cam means 50 may be embodied in different ways. In FIG. 5 a ring 48*a* is provided against which spring 46 bears. Tubes 26, 20 are provided with mating inclined surfaces which, when rotated relative to each other, changes the setting of the needle valve.

FIGS. 6 and 7 show another embodiment of the invention wherein cam means 50 comprise a pair of projections 26*c* extending from the end of tube 26 and bearing against a shaped cam surface 60. As shown in FIG. 7, surface 60 may have selected areas for achieving various fuel flow conditions. With projections 26*c* moving along the area 60*a* of cam surface 60, an anti-dieseling shut-off of fuel flow can be established. Area 60*b* is a rich idle area. Area 60*c* is a lean mixture running area for normal vehicle using, with area 60*d* comprising a full throttle area of maximum power.

To prevent leakage of fuel in passage 20*a*, an O-ring 64 is provided between the outer surface of portion 26*a* and inner surface of passage 20*a*.

An idle/full throttle stop lever 66 is also fixed to outer hollow tube 20 which, as shown in FIG. 2, can be selectively positioned using solenoid 68 having piston 70. The idle can be adjusted for normal running by adjusting the fixed unactivated position of piston 70 using threaded end 68*a* of two position solenoid 68, threaded into a bracket 72 connected to plate 28. During normal operation with the ignition (not shown) activated, any movement of throttle linkage 58 toward increased air-fuel flow will allow solenoid 68 to cause piston 70 to pop out into its running position (dotted line). During normal running, lever 66 varies in angular position from angle $\beta$ to $\gamma$. A spring (not shown) on cable 58 returns carburetor to idle position when pressure is removed from the gas pedal (not shown). When the ignition is switched off piston 70 is allowed to drop back into the anti-dieseling position (solid line). Should the solenoid not be used, a simple idle adjustment screw can be employed instead in conjunction with an inline solenoid fuel shut-off valve. The position shown in FIG. 2 in solid line is the stop position where no fuel is suppled through the carburetor.

The angles thus formed between the horizontal and a bottom surface of lever 66, are respectively an anti-diesel protection angle $\alpha$, an idle adjust angle $\beta$, and a full throttle over-run stop angle $\gamma$ caused by the top surface 66*a* at lever 66 hitting bottom surface 28*a* of flange 28.

For vehicles with automatic transmission, a mechanism in the form of disc 74 and linkage 74*a* and another linkage (not shown) which are engageable between disc 74 and lever 56 may be provided. Disc 74 is rotated by a selective amount to achieve a selected rotation of lever 56.

In another embodiment levers 56 and 66 can be on the same end of the carburetor as the fuel line and spring assembly.

Figure 10:
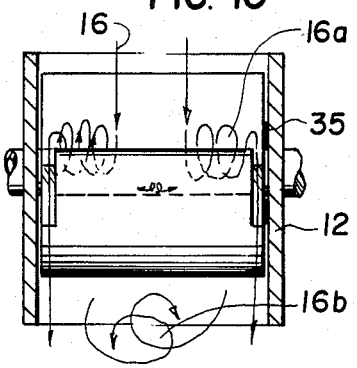
FIGS. 10 and 11 are front elevations, partly in section, of FIGS. 8 and 9, respectively.

FIGS. 8 to 11 illustrate the operation of the inventive carburetor. Air valve member 18 which is roughly J-shaped has a curved air flow conducting surface facing the air stream 16. FIGS. 8 and 10 show the idle or closed position for valve member 18. In this position, a vortex flow 16*a* is established by surface 18*a* which facilitates the atomization of the small amount of fuel supplied from the metering equipment.

A turbulence area 16*b* behind member 18 further facilitates air-fuel mixture.

Idle by-pass ports 76, formed as cut-out steps in the curved end of member 18 permit the passage of the air fuel mixture. There is also some leakage at 16*c* past the end of member 18. Air passing the opposite end of member 18 at rake angle $\delta$ facilitate the formation of secondary turbulence 16*b*.

The full throttle-position is shown in FIGS. 9 and 10 where the establishment of vortex flow 16*a* is maximized for maximum atomization of the fuel with the air flow.

Vacuum ports 200 can be inserted in 12 between air valve 18 and bottom flange 30.

Figure 12:
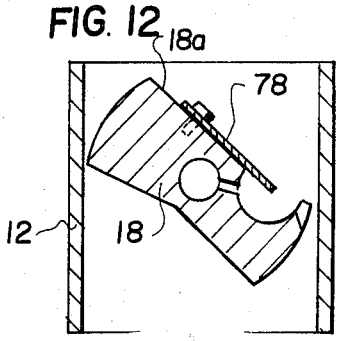
FIG. 12 is a view similar to FIG. 8 showing another embodiment of the air J-valve member.
Figure 11:
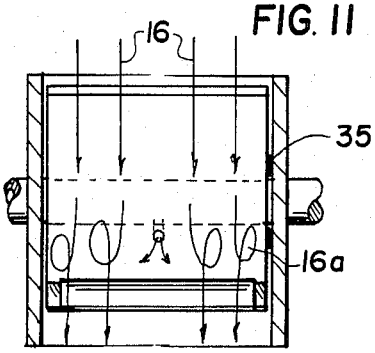

FIG. 12 shows a modified version of the J-shaped air valve having an adjustable plate 78 for movement over a portion of curved surface 18*a* to finely adjust the amount of vortex formation.

FIGS. 13 to 18 illustrate two additional embodiments for the air valve member 18 which can be designated internal vortex air valve members. The difference between these two embodiments are best illustrated in FIGS. 17 and 18. The internal vortex valve member 80 shown in FIG. 17 comprises a cylindrical shell 82 having opposite ends 84 which facilitate connection to outer tube 20 of the fuel metering arrangement. The curved air-conducting surface is defined on an inner surface of cylindrical shell 82. Air enters the shell through inlet port 86, moves in a vortex flow 16*aa* within shell 82 mixes with fuel 16*bb*, exits in this embodiment through two outlet ports 88. In another embodiment, air can enter in one top port at one axial end of the tube and leave by a second port at the other axial end.

The embodiment of FIG. 18 is substantially the same except that, rather than having end portions 84, the valve member 80 of FIG. 18 includes fins 90 for establishing connection with tube 20. Fins 90 also somewhat change the characteristics of the vortex within shell 82. Fins 90 are inboard of outlet ports 80 so that the vortex is reinforced more positively than with the embodiment of FIG. 17.

Figure 13:
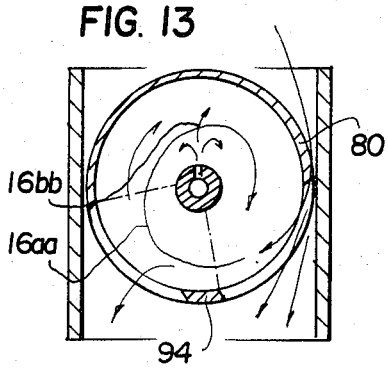
FIGS. 13, 14 and 15 are views similar to FIGS. 8 and 9, showing a still further embodiment of the air valve member in its respective idle, normal running and full throttle positions.
Figure 14:
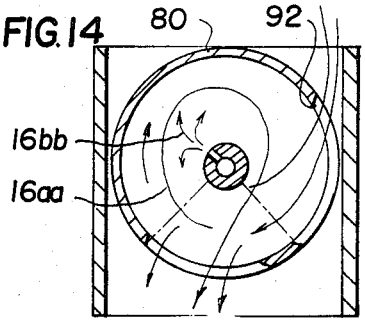
Figure 16:
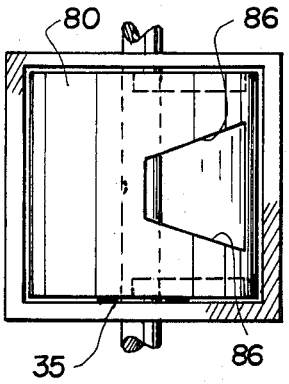
FIG. 16 is a top plan view of the invention illustrated in FIGS. 13–15.
Figure 15:
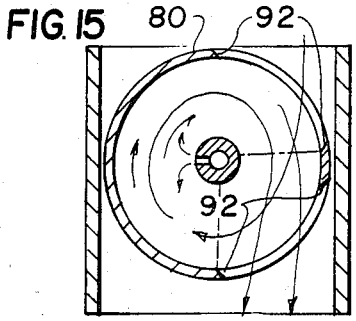

FIGS. 13 to 15 respectively show an idle, normal running and full throttle position for valve member 80. Fin 90 is shown schematically in dot-data line. FIG. 16 is a top plan view of the valve member according to the embodiment of FIG. 18 showing the inlet port 86 which is rhomboid in shape having non-parallel edges diverging in the direction of air flow around member 80. This design is not restricted to the rhomboid shape; other opening shapes can be used.

As shown in FIGS. 13 to 15, the upstream and downstream edges 92 of inlet and outlet ports 86, 88 are selectively bevelled to increase the vortex forming flow of air into shell 82. A web area 94 extends axially across the member 80 by a selected small circumferential distance to separate the inlet port 86 from the outlet port 88. This also increases the tendency of the air flow to form a vortex in shell 82 rather than merely to flow in the inlet port and out the outlet ports without forming such a vortex. The shorter arrows (16*bb*) in FIGS. 13 to 15 show the injection of fuel from the fuel metering apparatus, with the longer arrows showing the air and air fuel mixture streams into and out of the valve member.

Due to the high velocity of the air stream in the inventive carburetor arrangement, carburetor heating means might be necessary to avoid icing. Such icing is the result of the so-called Ranque-Hilsch effect which causes warmer, lighter fluid to collect at the center of the whirling vortex as a consequence of the heavier cooler gases being forced to the walls by centripetal acceleration, or by evaporative chilling caused by the rapidly atomizing gasoline or by adiabatic expansion. An electrical heater might by provided or, in accordance with the embodiment of FIG. 19, input air can be provided over a line 96 to a heat exchanger 98 which is associated with an exhaust pipe 100. The input air is heated up by contact with the outer surface of exhaust pipe 100 and is returned over return air line 102 to the upstream and downstream sides of valve member 80. Curved walls 104 may be provided to improve the flow of warm air around member 80.

Figure 20:
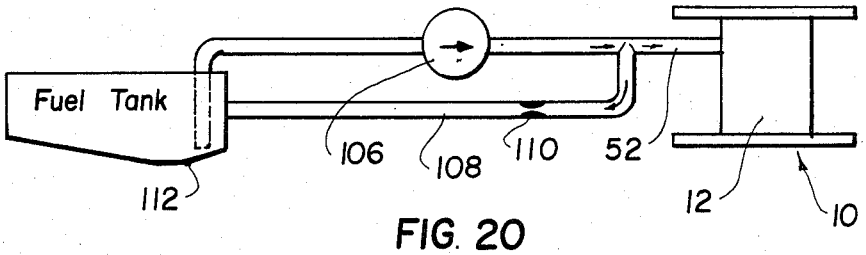
FIG. 20 is a schematic representation of an anti-percolation system according to the invention.

FIG. 20 shows an anti-percolation system for the inventive carburetor arrangement. The inventive carburetor may have a tendency to cause fuel to percolate (boil) in a sufficiently high temperature operation. To avoid this problem, fuel line 52 having fuel pump 106 is provided with a fuel return line 108 including a throttle or restricting orifice 110 for the return of fuel to fuel tank 112. In this way, surplus fuel is returned to the tank and not supplied to the carburetor housing 12.

Figure 21:
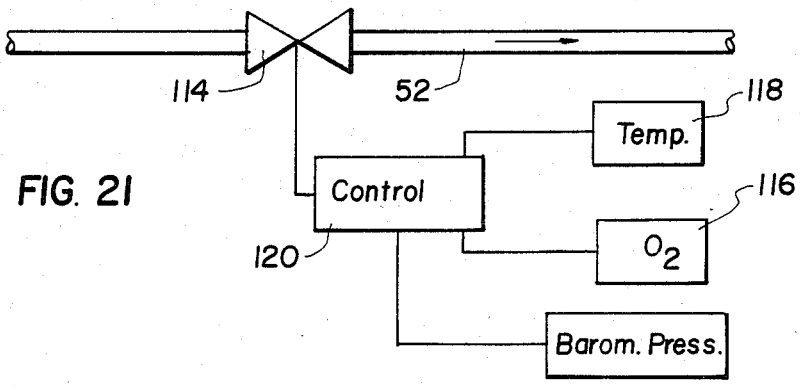
FIG. 21 is a schematic representation of an air-fuel mixture control according to the invention.

Referring to FIG. 21, in order to control the air-fuel ratio during both cold start and steady-state operated conditions, subject to the Environmental Protection Agency (EPA) limitations, the needle valve arrangement can be set for a rich fuel mixture. A servo-controlled fuel line gate valve 114 is provided in the fuel line 52 to lean out the mixture subject to prescribed limitations on sensor monitored engine temperature and engine exhaust conditions, such as the amount of exhaust oxygen, estabished by oxygen sensor 116, to control emissions or allow a rich mixture for a cold start. Engine temperature sensor 118 may also be provided. The sensor values are sent to a control element 120 which may be of known design to control valve 114.

Figure 22:
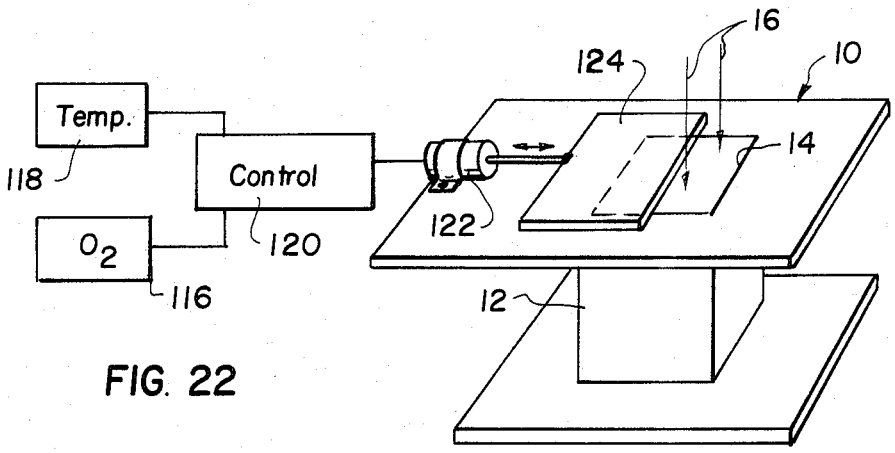
FIG. 22 is a schematic representation of an air inlet in accordance with the invention.

Alternatively, and as shown in FIG. 22, sensors 116, 118 with control 120 may be connected to a solenoid 122 which has a piston connected to an air flow plate 124 movable over the inlet opening of air flow conduit 14. This forms a gate or butterfly valve for regulating the amount of air into the carburetor. Closure of this valve enriches the mixture by reducing the volume of air while maintaining the fuel flow at a constant rate. The valves of FIGS. 21 and 22 may be used separately or together and can also be automatically or manually operated (for example in accordance with automatic or manual choke).

FIGS. 23 and 24 show multiple barreled versions of the inventive carburetor.

In FIG. 23, a two-barrel carburetor is shown wherein one barrel having outer hollow tube 20 is regulated by lever and linkage 56, 58. The outer hollow tube 20′ of the second carburetor 10′ is controlled over a gear box 126 which rotates tube 20′ at a selected angular relationship and amount, to the rotation of tube 20 for providing desired power output conditions of the combined two-barrel carburetor arrangement.

FIG. 24 shows a four-barrel version wherein the carburetor 10 is controlled directly by levers 56 and 56′ and linkage 58, with the other carburetors 10′, 10″ and 10‴ being controlled over respective gear boxes 126′, 126″ and 126‴. The inventive carburetor designs may also be combined with conventional float carburetors to establish the desired power settings.

While specific embodiments of the invention have been shown and described in detail to illustrate the application of the principles of the invention, it will be understood that the invention may be embodied otherwise without departing from such principles.

What is claimed is:

1. A high velocity carburetor comprising:

conduit means defining an air flow conduit for carrying a flow of air in a flow direction;

a valve member in said air flow conduit and movably mounted to said conduit means from a closed position for reducing air flow in said conduit to an open position for increasing air flow in said conduit, said valve member having a curved air flow conducting surface facing toward the air flow direction with said valve member in at least one of its closed and open positions;

fuel metering means connected to said valve member for providing fuel to said curved air flow conducting surface;

said valve member being J-shaped and having an exterior surface facing the air flow direction in the closed position of said valve member which forms said curved air flow conducting surface, said J-shaped valve member having opposite cylindrical surfaces centered about an axis of rotation of said valve member in said conduit means, said valve member having a toe end at a base of its J-shape with cut-out portions forming air passage ports in said air flow conduit for passage of air with said valve member in its closed position, and said J-shaped valve member further having a surface opposite said curved air flow conducting surface with a downstream flat portion and an upstream flat portion in the air flow direction, said upstream flat portion being at a rake angle with respect to said downstream portion for establishing air turbulence downstream of said valve member in said air flow direction.

2. A carburetor according to claim 1, wherein said conduit means comprises a housing, said fuel metering means comprising a first fuel conduit rotatably mounted and axially fixed with respect to said housing having a portion forming one of a valve seat and a valve projection, a second fuel conduit rotatably fixed and axially movable with respect to said housing and having a portion defining the other of said valve seat and valve projection, and cam means defined between said first and second fuel conduits, one of said first and second fuel conduits having an opening for the passage of fuel away from said valve seat and into said flow conduit, said first fuel conduit fixed to said valve member for co-rotation therewith.

3. A carburetor according to claim 2, wherein said first fuel conduit defines said valve seat and carries said opening, said first fuel conduit having an axially extending passage therein communicating with said valve seat, said second fuel conduit having an axially extending opening therethrough and having an end forming said valve projection, said valve member having an opening therein aligned with said opening of said first fuel conduit for the passage of fuel to said air flow conduit.

4. A carburetor according to claim 3, wherein said cam means comprises a cam surface defined on an end of said first fuel conduit extending out of said housing, a cam follower connected to said second fuel conduit and engaged with said cam surface and biasing means biasing said cam follower against said cam surface.

5. A carburetor according to claim 1, including heating means for heating said valve member.

6. A carburetor according to claim 1, including a fuel line connected to said fuel metering means, a valve in said fuel line, a control element connected to said valve and a sensor for sensing at least one engine parameter connected to said control element for regulating said valve.

7. A carburetor according to claim 1, including an air flow valve connected to said conduit means for changing a cross-sectional area of said air flow conduit and control means connected to said air flow valve for changing the position of said air flow valve.

8. A carburetor according to claim 1, including a fuel tank for containing a supply of fuel, a fuel line connected between said fuel tank and said fuel metering means, a pump in said fuel line for supplying fuel from said tank to said fuel metering means, a return line connected from said fuel line at a position upstream of said fuel metering means and downstream of said pump in a fuel flow direction, and to said fuel pump, and a restriction in said return line for selectively restricting a return flow of fuel to said tank.

9. A high velocity carburetor comprising:

conduit means defining an air flow conduit for carrying a flow of air in a flow direction;

a valve member in said air flow conduit and movably mounted to said conduit means from a closed position for reducing air flow in said conduit to an open position for increasing air flow in said conduit, said valve member having a curved air flow conducting surface facing toward the air flow direction with said valve member in at least one of its closed and open positions;

fuel metering means connected to said valve member for providing fuel to said curved air flow conducting surface;

said valve member being J-shaped and having an exterior surface facing the air flow direction in the closed position of said valve member which forms said curved air flow conducting surface; and a plate connected to said J-shaped valve member and extending partially over a curved base of said curved air flow conducting surface, said plate being adjustably positionable for regulating an overhang amount of said plate over said curved base portion.

* * * * *